US005475931A

United States Patent [19]

Wei

[11] Patent Number: 5,475,931

[45] Date of Patent: Dec. 19, 1995

[54] MULTIFUNCTIONAL DRAWING IMPLEMENT BOX

[76] Inventor: Ching-Lin Wei, 3Fl.-1, No. 274, Tsuihwa Rd., Kushuan Dist., Kaohsiung, Taiwan

[21] Appl. No.: 287,162

[22] Filed: Aug. 8, 1994

[51] Int. Cl.[6] ..... B43L 7/10

[52] U.S. Cl. ..... 33/471; 33/485; 33/558.01

[58] Field of Search ..... 33/1 N, 452, 465, 33/471, 484, 485, 496, 497, 558.01; 206/224, 371

[56] References Cited

U.S. PATENT DOCUMENTS

| | | | |
|---|---|---|---|
| 185,977 | 1/1877 | Smith | 33/485 |
| 1,212,549 | 1/1917 | Parent | 33/465 |
| 1,299,978 | 4/1919 | MacDowney | 33/471 |
| 2,735,185 | 2/1956 | Naphtal | 33/497 |
| 4,815,881 | 3/1989 | Chern | 33/558.01 |
| 4,905,830 | 3/1990 | Lin | 206/224 |

FOREIGN PATENT DOCUMENTS

| | | | |
|---|---|---|---|
| 905888 | 7/1949 | Germany | 33/485 |
| 4309345 | 9/1994 | Germany | 33/1 N |
| 4810 | of 1909 | United Kingdom | 33/465 |
| 683415 | 11/1952 | United Kingdom | 33/465 |

*Primary Examiner*—Thomas B. Will

*Attorney, Agent, or Firm*—Ross, Clapp, Korn & Montgomery

[57] ABSTRACT

A drawing implement box includes a first ruler section, a second ruler section which has a scale of angles thereon, and a positioning member for securing the first and second ruler sections together yet allowing relative rotational movements therebetween for measuring angles. Each of the first and second ruler sections has a compartment therein for receiving a drawing implement goods.

14 Claims, 4 Drawing Sheets

MULTIFUNCTIONAL DRAWING IMPLEMENT BOX

BACKGROUND OF THE INVENTION

1. Field of the Invention

The present invention relates to a multifunctional drawing implement box and, more particularly, to a drawing implement box which also can be used as a ruler, protractor, paperweight, and pen holder.

2. Description of Related Art

It is a trend to design articles with multifunctions. This concept also fits in the drawing implement field. However, a conventional multifunctional drawing implement set generally consists of a ruler, protractor, and drawing implement box which are only modified in the outlines while they still remain as individual articles which are independent from each other. This causes inconvenience in carriage, use, and storage. Furthermore, conventional rulers are generally formed of a plastic material which, after a long-term use, is apt to be deformed and bent when of a relatively small thickness, resulting in inaccuracies and inconvenience in measuring.

The present invention is intended to provide an improved multifunctional drawing implement to mitigate and/or obviate the above-mentioned problems.

SUMMARY OF THE INVENTION

It is an object of the present invention to provide a multifunctional drawing implement box which includes a first ruler section, a second ruler section, and a positioning means. The first ruler section includes a first ruler plate with a scale of lengths on a first lateral side thereof and a substantially semi-cylindrical first member extending upwardly from a second lateral side thereof, a first disc extending from a first end of the first member. The first member further includes a compartment therein for receiving drawing implement goods.

The second ruler section includes a second ruler plate with a scale of lengths on a first lateral side thereof and a substantially semi-cylindrical second member extending upwardly from a second lateral side thereof, a second disc extending from a first end of the second member and has a scale of angles on a circumference thereof. The second member further includes a compartment therein for receiving drawing implement goods.

The positioning means secures the first and second ruler sections together yet allows relative rotational movements therebetween for measuring angles or accessing the drawing implement received in the compartments. Each of the first and second ruler sections further has a vertical conical hole for holding a writing instrument.

Other objects, advantages, and novel features of the invention will become more apparent from the following detailed description when taken in conjunction with the accompanying drawings.

DESCRIPTION OF THE PREFERRED EMBODIMENTS

Figure 1:
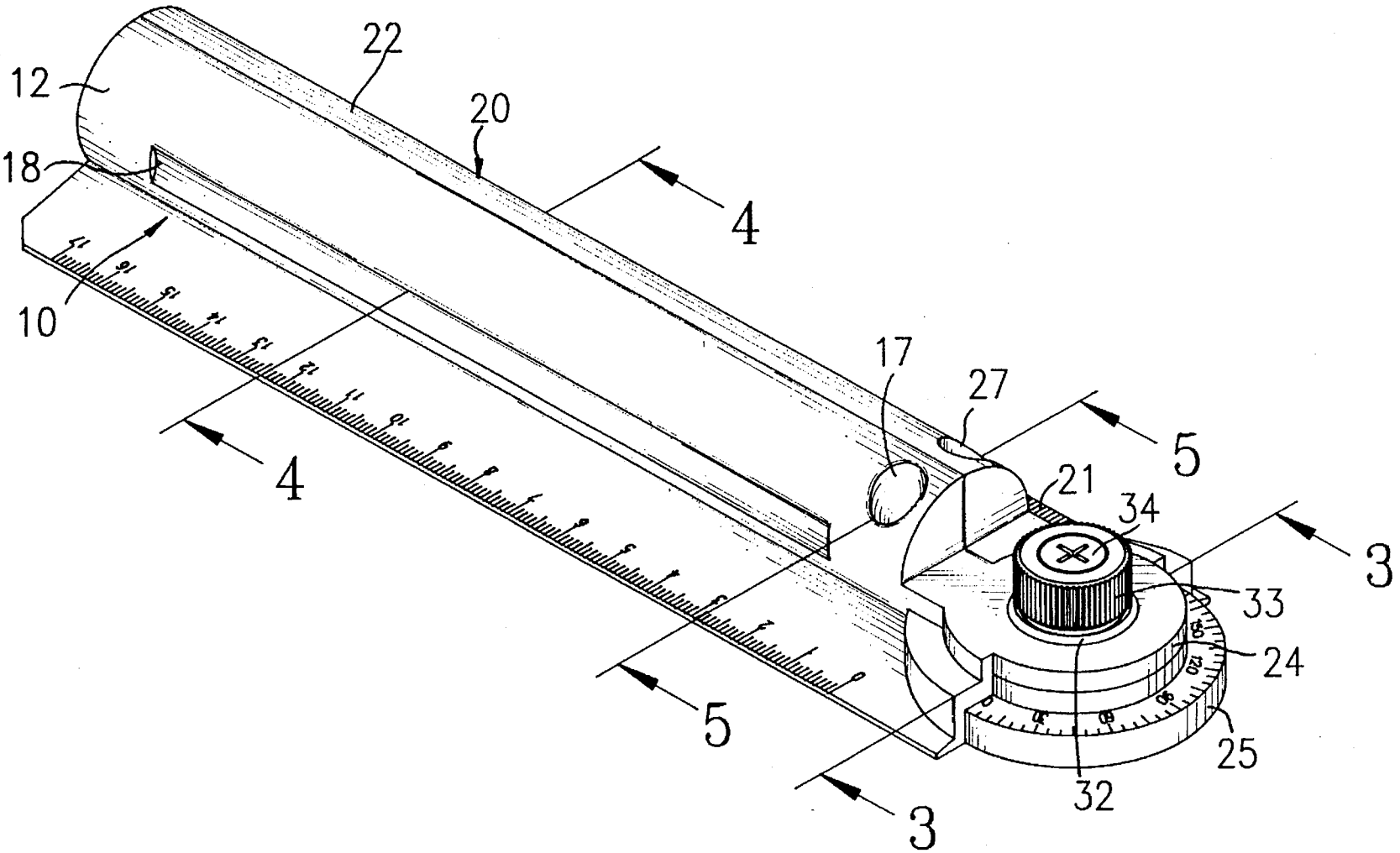
FIG. 1 is a perspective view of a multifunctional drawing implement box in accordance with the present invention.
Figure 2:
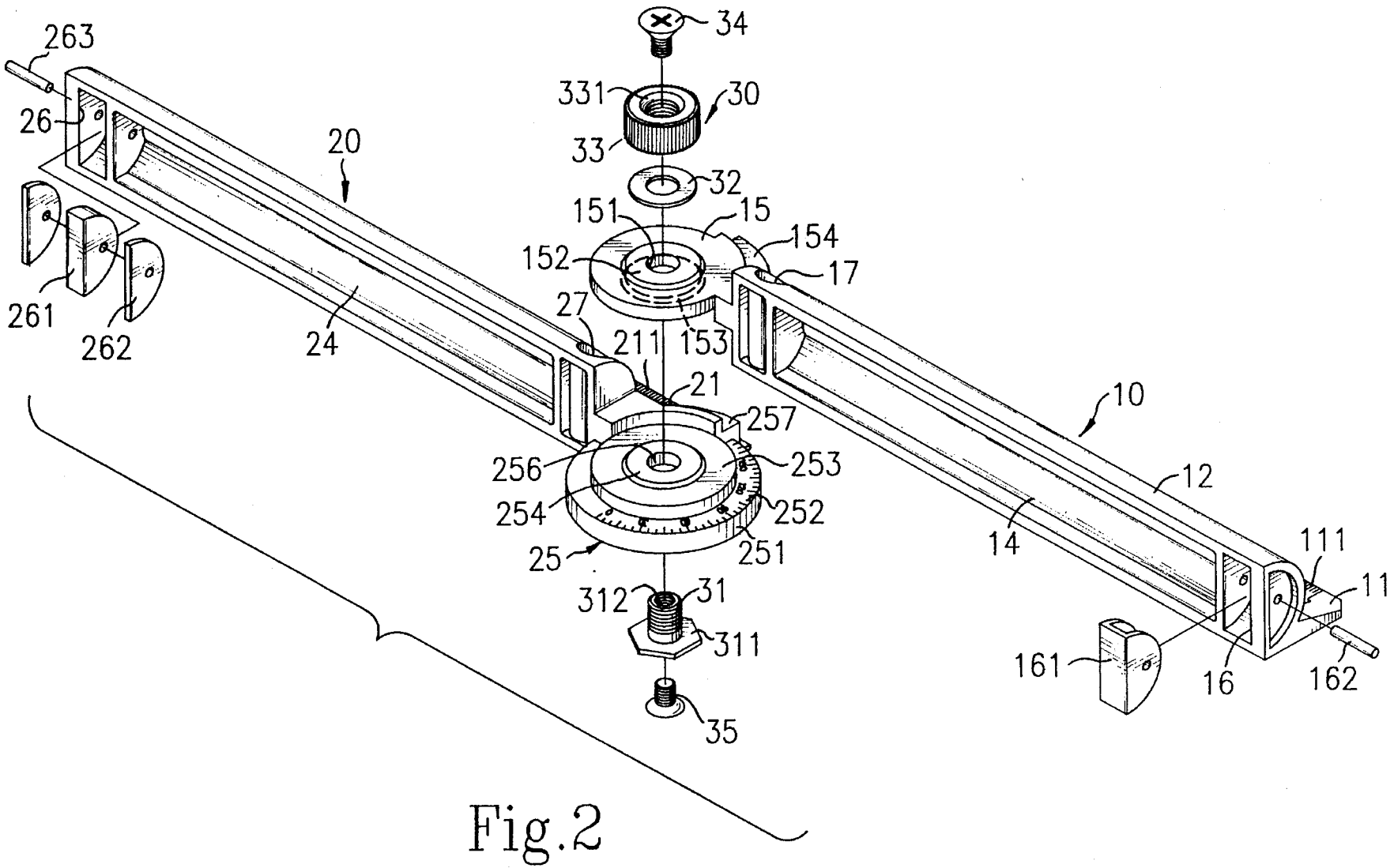
FIG. 2 is an exploded view of the multifunctional drawing implement box in accordance with the present invention.

Referring to the drawings and initially to FIGS. 1 and 2, a multifunctional drawing implement box in accordance with the present invention generally includes a first ruler section 10, a second ruler section 20, and a positioning means 30.

Figure 4:
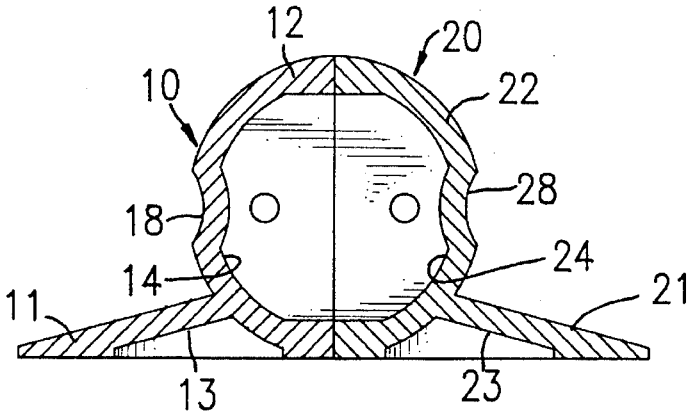
Figure 5:
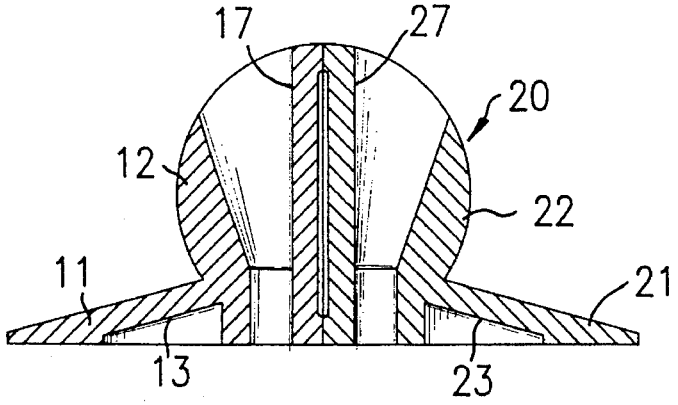

The first ruler section 10 is transparent and made of plastic material. The first ruler section 10 includes a first ruler plate 11 which extends in a horizontal direction and has a scale 111 of linear lengths on a first lateral side of an upper surface thereof and a substantially semi-cylindrical member 12 extending upwardly from a second lateral side of the upper surface of the first ruler plate 11. As best shown in FIGS. 4 and 5, the upper surface of the first ruler plate 11 is preferably inclined from the second lateral side toward the first lateral side thereof. A recess 13 (see FIG. 4) is defined in an underside of the first ruler plate 11, the purpose of which will be explained later. The semi-cylindrical member 12 includes a flat vertical surface (not labeled) which is opposite to the scale 111 and in which a substantially semi-cylindrical compartment 14 is defined. Referring to FIG. 2, a substantially circular disc 15 projects outwardly from a first end of member 12 and includes a central hole 151 having a vertical axis. A boss 152 is formed on an upper side of the circular disc 15 around the central hole 151, and a conical recess 153 is defined in an underside of the circular disc 15 around the central hole 151. A step 154 extends along a section of an outer peripheral edge of the circular disc 15 and is preferably integral with the first ruler section 11 (see FIG. 1).

Furthermore, a receptacle 16 (see FIG. 2) is defined in the flat vertical surface adjacent to a second end of member 12 for securely receiving therein a ferrous plate 161 by a pin 162, the purpose of which will be explained in detail later. Preferably, as shown in FIG. 5, member 12 has a vertical conical hole 17 in a first end thereof for holding a writing instrument. Member 12 may further have a groove 18 (see FIG. 1) extending along a curved lateral surface thereof which faces the associated scale 111 for fingers' grasping when in use.

The second ruler section 20 is also transparent and made of plastic material. The second ruler section 20 includes a second ruler plate 21 which extends in a horizontal direction and has a scale 211 of linear lengths on a first lateral side of an upper surface thereof and a substantially semi-cylindrical member 22 extending upwardly from a second lateral side of the upper surface of the second ruler plate 21. Again, as best shown in FIGS. 4 and 5, the upper surface of the second ruler plate 21 is preferably inclined from the second lateral side toward the first lateral side thereof. A recess 23 (see FIG. 4) in defined in an underside of the second ruler plate 21, the purpose of which will be explained later. The semi-cylindrical member 22 includes a flat vertical surface which is opposite to scale 211 and in which a substantially semi-cylindrical compartment 24 is defined. A substantially circular disc 25 projects outwardly from a first end of member 22 and includes a base 251 (for providing a stable structure) having a scale 252 of angles on a circumference of an upper side thereof, a flange 253 formed on the upper side of the base 251, a boss 254 formed on an upper side of the flange 253, a conical recess 255 defined in an underside of the base 251 (the recess 255 extends into an underside of the flange 253, see FIG. 3), and a vertical central through hole 256 extending through base 251, flange 253, and boss 254. A step 257 (see FIG. 3) extends along a section of an outer peripheral edge of the circular disc 25 and is preferably integral with the second ruler section 21. It is appreciated that disc 25 extends from member 21 at a height lower than the relative extending point from which disc 15 extends from member 11, such that disc 15 may be superimposed upon disc 25, while undersides of the ruler plates 11 and 21 locate on the same plane, as shown in FIG. 3.

Furthermore, a receptacle 26 (see FIG. 2) is defined in the flat vertical surface adjacent to a second end of member 22 for securely receiving therein a magnet 261 and two ferrous plates 262 mounted to both sides of the magnet 261 by a pin 263, the purpose of which will be explained in detail later. Preferably, as shown in FIG. 5, member 22 has a vertical conical hole 27 in a first end thereof for holding a writing instrument. Member 22 may further have a groove 28 (see FIG. 4) extending along a curved lateral surface thereof which faces the associated scale 211 for fingers' grasping when in use.

Still referring to FIG. 2, the positioning means 30 includes a bolt 31 having a hexagonal bolt head 311 and a threaded longitudinal through hole 312 therein, a washer 32, a nut 33, and upper and lower screws 34, 35. Preferably, the nut 33 has a countersink 331 in an upper side thereof for receiving the bolt head (not labeled) of the upper screw 34.

Figure 3:
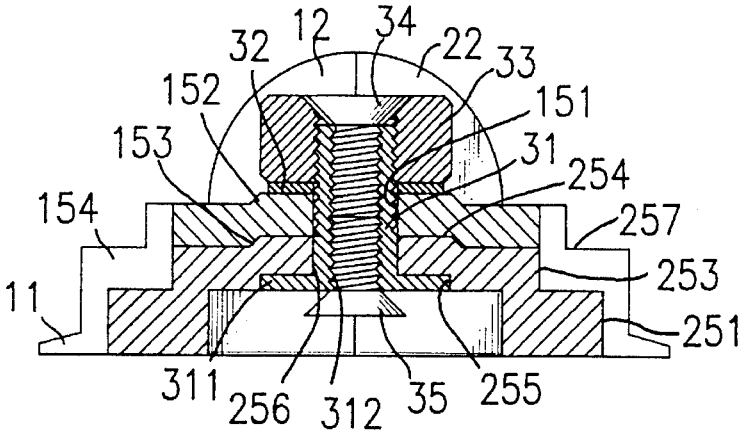
FIGS. 3 through 5 are cross-sectional views respectively taken along lines 3—3, 4—4, and 5—5, in FIG. 1.

In assembly, referring to FIGS. 2 and 3, disc 15 of the first ruler section 10 is superimposed upon disc 25 of the second ruler section 20 with boss 254 rotatably received in conical recess 153. Then, bolt 31 is inserted from the underside of disc 25 and extends through holes 256 and 151 for subsequent engagement with nut 33 (bolt head 311 is received in recess 255) for securing the first and second ruler sections 10 and 20 together. Thereafter, upper and lower screws 34 and 35 are respectively mounted to upper and lower ends of bolt 31 until screw ends of the screws 34 and 35 contact with each other (see FIG. 3) in which position bolt 31 is allowed to have a rotational movement not exceeding 180° or 360°.

Figure 6:
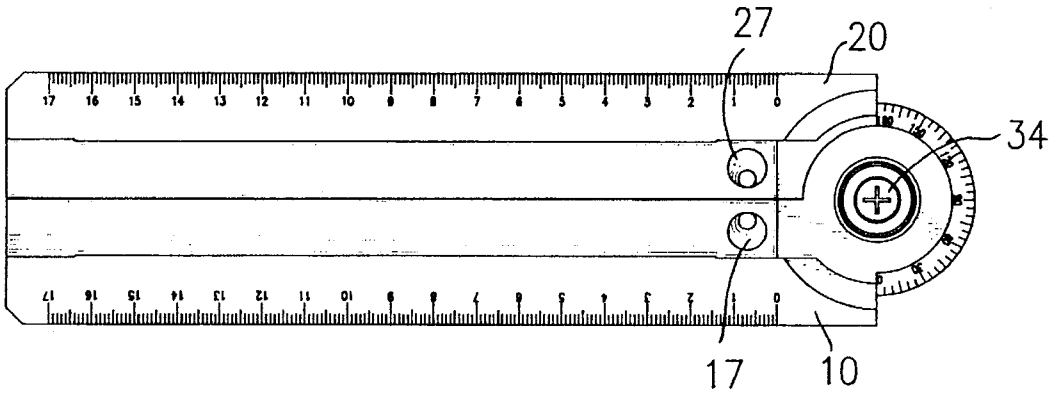
FIG. 6 is a top plan view of the multifunctional drawing implement box in a folded status.

When in a folded status shown in FIGS. 1 and 6, ferrous plates 161 and 262 attract each other due to the provision of the magnet 261, and the nut 33 may be fixed upon rotation thereof to provide a stable drawing implement box, in which drawing implements, such as writing instruments and/or small articles may be received in compartments 14 and 24. In addition to the function of a ruler provided by scales 111 and 211, the drawing implement box may also be used as a paperweight as the members 12 and 22 have certain weights. This also avoids deformation or bending of the ruler plates 11 and 21. Another advantage of the drawing implement box is that the user may hold and move it easily by means of grasping the grooves 18 and 28 with his/her fingers, while conventional rulers require a pushing force when movement is required.

Figure 7:
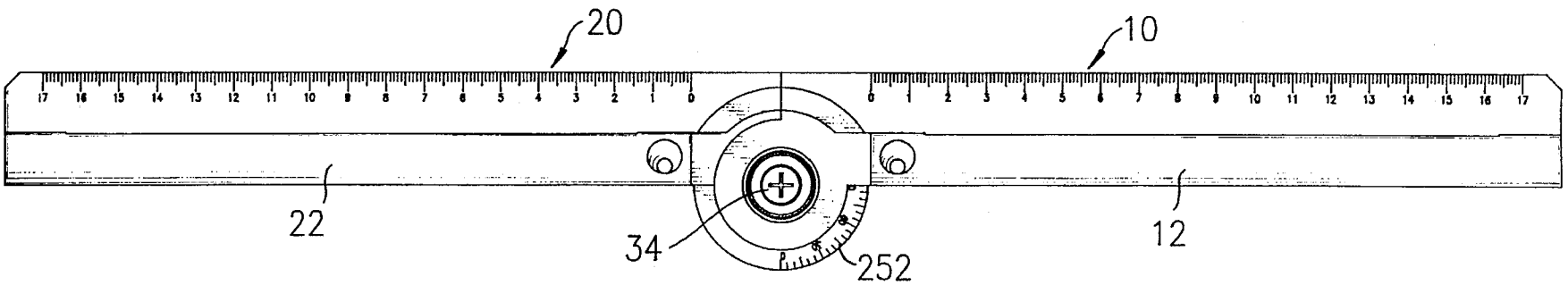
FIG. 7 is a top plan view of the multifunctional drawing implement box in a fully-extended status.

For measuring angles, the nut 33 is slackened to allow rotational movement of the first ruler section 10 relative to the second ruler section 20. The value of the angle is read from scale 252 when the edges of the flat vertical surfaces of two members 12 and 22 respectively coincide with two sides of the angle to be measured. As shown in FIG. 6, the present box allows an angular measurement up to 180°. It is appreciated that steps 154 and 257 are arranged such that steps 154 and 257 contact with each other and that the ruler sections 10 and 20 align with each other when in an extended status shown in FIG. 7. It is appreciated the present drawing implement box may be used to measure an angle of a three-dimensional object as well as a two-dimensional angle. When opening the stationary box, the user may grasp in recesses 13 and 23 to facilitate separation of the first and second ruler sections 10 and 20.

According to the above description, it is appreciated that the invention provides a multifunctional drawing implement box which may also serve as a ruler, protractor, paperweight, and a pen holder.

Although the invention has been explained in relation to its preferred embodiment, it is to be understood that many other possible modifications and variations can be made without departing from the spirit and scope of the invention as hereinafter claimed.

I claim:

1. A drawing implement box comprising:

a first ruler section comprising:

a first ruler plate which extends in a horizontal direction and has a first scale of lengths on a first lateral side thereof and a substantially semi-cylindrical first member projecting upwardly from a second lateral side thereof, the first member having a first disc extending from a first end thereof and a compartment defined therein;

a second ruler section comprising:

a second ruler plate which extends in a horizontal direction and has a second scale of lengths on a first lateral side thereof and a substantially semi-cylindrical second member projecting upwardly from a second lateral side thereof, the second member having a second disc member extending from a first end thereof and a compartment defined therein, the second disk having a third scale of angles on a circumference thereof, and being disposed below the first disc thereby allowing relative rotational movement between the first and second ruler sections; and a positioning means comprising a bolt which passes through the first and second discs and a nut mounted around the bolt for retaining the first and second discs together.

2. The drawing implement box as claimed in claim 1 wherein at least one of the first and second ruler sections has a vertical conical hole therein for holding a writing instrument.

3. The drawing implement box as claimed in claim 1 wherein at least one of the first and second ruler plates has an upper surface which is inclined from the second lateral side thereof toward the first lateral side thereof.

4. The drawing implement box as claimed in claim 1 wherein at least one of the first and second ruler plates has a recess defined in an underside thereof.

5. The drawing implement box as claimed in claim 1 wherein each of the first and second discs includes a step extending along a section of an outer peripheral edge thereof, the steps contacting with each other when the first and second ruler plates align with each other.

6. The drawing implement box as claimed in claim 1 wherein each of the first and second members has a groove extending in a periphery thereof which faces the associated one of first and second scales.

7. The drawing implement box as claimed in claim 1 wherein each of the first and second members has a receptacle defined in a second end thereof, and a magnet with two first ferrous plates at both sides thereof are securely mounted in one of the receptacles and a second ferrous plate is securely mounted in the other receptacle, the ferrous plates attract each other when the first and second ruler sections lie side by side.

8. A drawing implement box comprising:

a first ruler section comprising:

a first ruler plate which extends in a horizontal direction and has a first scale of lengths on a first lateral side thereof and a substantially semi-cylindrical first member projecting upwardly from a second lateral side thereof, the first member having a first disc extending from a first end thereof and a compartment defined therein, the first disc having a first recess in an underside thereof and a first vertical central hole;

a second ruler section comprising:

a second ruler plate which extends in a horizontal direction and has a second scale of lengths on a first lateral side thereof and a substantially semi-cylindrical second member projecting upwardly from a second lateral side thereof, the second member having a second disc extending from a first end thereof and a compartment defined therein, the second disc and being disposed below the first disc, the second disc having a third scale of angles on a circumference thereof, a boss which is formed on an upper side thereof and rotatably received in the first recess in the first disc, and a second recess in an underside thereof; and a positioning means comprising:

a bolt which passes through the first and second discs and having a bolt head received in the second recess in the second disc and a threaded longitudinal through hole having upper and lower ends;

a nut mounted around the bolt above the first disc for retaining the first and second discs together yet allowing relative rotational movements therebetween;

a first screw mounted to the lower end of the threaded longitudinal through hole of the bolt; and a second screw mounted to the upper end of the threaded longitudinal through hole of the bolt and contacting with the first screw for restraining rotational movement of the bolt.

9. The drawing implement box as claimed in claim 8 wherein at least one of the first and second ruler sections has a vertical conical hole therein for holding a writing instrument.

10. The drawing implement box as claimed in claim 8 wherein at least one of the first and second ruler plates has an upper surface which is inclined from the second lateral side thereof toward the first lateral side thereof.

11. The drawing implement box as claimed in claim 8 wherein at least one of the first and second ruler plates has a further recess defined in an underside thereof.

12. The drawing implement box as claimed in claim 8 wherein each of the first and second discs includes a step extending along a section of an outer peripheral edge thereof, the steps contacting with each other when the first and second ruler plates align with each other.

13. The drawing implement box as claimed in claim 8 wherein each of the first and second members has a groove extending in a periphery thereof which faces the associated one of first and second scales.

14. The drawing implement box as claimed in claim 8 wherein each of the first and second members has a receptacle defined in a second end thereof, and a magnet with two first ferrous plates at both sides thereof are securely mounted in one of the receptacles and a second ferrous plate is securely mounted in the other receptacle, the ferrous plates attract each other when the first and second ruler sections lie side by side.

* * * * *